United States Patent [19]

Gross

[11] Patent Number: 5,038,957

[45] Date of Patent: Aug. 13, 1991

[54] TWO-PIECE, SNAP-ACTION CLOSURE WITH BODY DECK SPRING PANEL

[75] Inventor: Richard A. Gross, Crystal Lake, Ill.

[73] Assignee: Seaquist Closures, a division of Pittway Corporation, Northbrook, Ill.

[21] Appl. No.: 484,226

[22] Filed: Feb. 23, 1990

[51] Int. Cl.[5] ..... B65D 43/24

[52] U.S. Cl. ..... 220/335; 220/338; 215/235; 222/517

[58] Field of Search ..... 220/335, 338; 215/235, 215/237; 222/517

[56] References Cited

U.S. PATENT DOCUMENTS

| | | | |
|---|---|---|---|
| Re. 30,861 | 2/1982 | Krawagna . | |
| 2,342,477 | 2/1944 | Magnenat . | |
| 2,734,222 | 2/1956 | Kiba . | |
| 2,833,447 | 5/1958 | Thiele . | |
| 2,889,087 | 6/1959 | Paull et al. . | |
| 2,960,254 | 11/1960 | Kiba . | |
| 3,120,879 | 2/1964 | Warner . | |
| 3,201,011 | 8/1965 | Brocken . | |
| 3,289,877 | 12/1966 | Wolf . | |
| 3,300,104 | 1/1967 | Burt . | |
| 3,628,215 | 12/1971 | Everburg . | |
| 3,752,371 | 8/1973 | Susuki et al. . | |
| 3,853,250 | 12/1974 | Alpern . | |
| 4,010,875 | 3/1977 | Babiol . | |
| 4,086,686 | 5/1978 | Takabayashi . | |
| 4,124,151 | 11/1978 | Hazard . | |
| 4,158,902 | 6/1979 | Chernack et al. . | |
| 4,170,315 | 10/1979 | Dubach et al. . | |
| 4,172,540 | 10/1979 | Erichson . | |
| 4,193,519 | 3/1980 | Dubach et al. . | |
| 4,219,138 | 8/1980 | Hazard . | |
| 4,220,248 | 9/1980 | Wilson et al. . | |
| 4,261,486 | 4/1981 | Bush et al. . | |
| 4,282,991 | 8/1981 | Hazard . | |
| 4,291,818 | 9/1981 | Nozawa et al. . | |
| 4,346,810 | 8/1982 | Kneissl . | |
| 4,377,247 | 3/1983 | Hazard et al. . | |
| 4,399,928 | 8/1983 | Klingler . | |
| 4,402,435 | 9/1983 | Libit . | |
| 4,403,712 | 9/1983 | Wiesinger . | |
| 4,441,637 | 4/1984 | Libit . | |
| 4,545,495 | 10/1985 | Kinsley . | |
| 4,615,462 | 10/1986 | Sacherer et al. . | |
| 4,625,898 | 12/1986 | Hazard . | |
| 4,632,266 | 12/1986 | Osswald . | |
| 4,645,086 | 2/1987 | Rosenthal . | |
| 4,666,068 | 5/1987 | Bush . | |
| 4,700,858 | 10/1987 | Bennett . | |
| 4,711,360 | 12/1987 | Ullman | 215/235 |
| 4,742,928 | 5/1988 | Braun . | |
| 4,775,065 | 10/1988 | Shastel | 215/235 |
| 4,776,501 | 10/1988 | Ostrowsky . | |
| 4,821,899 | 4/1989 | Nycz et al. . | |

FOREIGN PATENT DOCUMENTS

| | | |
|---|---|---|
| 2120079 | 11/1972 | Fed. Rep. of Germany . |
| 449737 | 8/1949 | Italy . |
| 1056999 | 2/1967 | United Kingdom . |

*Primary Examiner*—Stephen Marcus
*Assistant Examiner*—Nova Stucker
*Attorney, Agent, or Firm*—Dressler, Goldsmith, Shore, Sutker & Milnamow, Ltd.

[57] ABSTRACT

A two-piece, snap-action closure includes a body and a separate lid. A biasing member is provided on the body to engage the rear portion of the lid to bias the lid to the full closed position or to the full open position from a bistable over center point. In a preferred embodiment, the biasing member is a cantilevered tab. In another embodiment the biasing member is a resiliently flexible member that presents a convex configuration toward the lid in the closed position. In one embodiment, the lid is pivotally mounted to the body with pivot members having oppositely facing flat sides which are received in rectangular receiving apertures. In another embodiment, the pivot members are cylindrical and are received in semi-cylindrical receiving apertures. In a preferred form of the closure, an angled cam surface is provided on the body to guide each pivot member into the receiving apertures.

10 Claims, 4 Drawing Sheets

TWO-PIECE, SNAP-ACTION CLOSURE WITH BODY DECK SPRING PANEL

TECHNICAL FIELD

This invention relates to a closure for use on the open end of a container from which the liquid contents can be dispensed.

BACKGROUND OF THE INVENTION AND TECHNICAL PROBLEMS POSED BY THE PRIOR ART

A variety of closures have been proposed over the years for use with containers wherein the closures include a lid connected to a body with a living hinge and wherein the lid moves between the open and closed positions with a snap-action effect. Although such closures may work generally satisfactorily for the service for which they were designed, there are applications in which a large number of open-close cycles of operation involving large movements or high stresses may cause the closures to fail with prolonged use.

Also, living hinges used for snap-action closures are typically molded as unitary structures from synthetic thermoplastic material. In some applications, a closure must be fabricated from materials from which an acceptable living hinge cannot be fabricated Further, in some applications, it would be beneficial to provide a closure lid and closure body made from dissimilar materials.

It would thus be desirable to provide a snap-action type closure that does not require a living hinge structure. This would permit a greater variety of materials to be used, and would permit the closure lid and body to be made in different colors Some designs have been proposed for closures which can be self-maintained in an open position and/or a closed position and wherein the lid and body are separate pieces. With some such designs, it may be relatively easy for the lid to be removed from the body, either accidentally or intentionally. However, in certain applications it would be desirable to provide an improved two-piece closure which would be relatively inexpensive to manufacture and relatively easy to assemble but which could not be easily disassembled. Such a non-removable lid would be a desirable feature in, for example, tamper-proof or tamper-evident closure designs.

SUMMARY OF THE INVENTION

According to the principles of the present invention, an improved two-piece closure is provided for use on a container, and it operates with an effective snap-action.

The closure is relatively inexpensive to manufacture and is readily assembled. However, the improved closure advantageously prevents removal of the closure lid from the closure body. Further, when open, the lid is held at a relatively large angle away from the dispensing orifice so as to insure no interference with the product flow from the container. In addition, the improved closure can be manufactured with a substantially smooth exterior surface having no protrusions.

The closure of the present invention includes a body for being mounted to the container over the container opening. The body defines a dispensing orifice for communicating at the container opening with the container interior. The body further includes an elastically or resiliently deflectable biasing member defining an engaging surface.

A lid is provided separately from the body and is disposed on the body for pivoting between a closed position occluding the dispensing orifice and an open position spaced away from the dispensing orifice. The lid includes a convex cam surface for moving against the engaging surface of the biasing member as the lid is pivoted between the open and closed positions.

The lid is pivotally mounted to the body with pivot members that are carried by one of the pieces and that are received in receiving means on the other of the pieces. If the pivot members are on the lid, then the receiving means are on the body. Alternatively, if the pivot members are on the body, then the receiving means are on the lid.

In one preferred form of the invention, each pivot member has two oppositely facing flat sides and projects laterally from the lid into a rectangular receiving aperture defined in the body.

Regardless of the specific structure of the pivot member and receiving means, another aspect of the invention relates to a novel structure for permitting assembly of the lid and body while preventing disassembly thereof. To this end, an angled cam surface is provided on one of the two pieces of the closure, i.e., on the lid or on the body. The pivot members are provided on the other piece and are guided by the cam surface into the receiving means as the lid and body are assembled. The components flex temporarily to accommodate engagement of the pivot members and receiving means.

Regardless of the structure of the pivot members and receiving means, and regardless of the presence or absence of angled cam surfaces to facilitate assembly of the closure pieces, another aspect of the invention relates to novel biasing structures which cooperate with the lid to bias the lid to the open or closed positions. In particular, in one embodiment, the biasing structure includes a tab that is cantilevered from the body and that defines a generally flat engaging surface for being engaged by the lid cam surface. In another embodiment, the biasing structure includes a resiliently flexible member that presents a convex configuration toward the lid and that has two ends which are connected to the body on either end of the convex configuration.

It has been found that these biasing member structures provide an effective snap-action and permit the closure to be fabricated from two pieces which can be assembled to provide a generally smooth, exterior surface without projecting hinge components.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

While this invention is susceptible of embodiment in many different forms, this specification and the accompanying drawings disclose only some specific forms as examples of the use of the invention. The invention is not intended to be limited to the embodiments so described, and the scope of the invention will be pointed out in the appended claims.

For ease of description, the closure of the invention is described in a position as it is usually encountered—upright on a container, and terms such as upper, lower, vertical, horizontal, etc. are used with reference to this position notwithstanding the fact that the container and closure may be used in other positions.

With reference now to the figures, a first embodiment of the closure of the present invention is represented generally by the numeral 30 in FIGS. 1–11. The closure 30 is adapted to be disposed on a container (not illustrated), such as the typical container which has a conventional mouth or opening defined by a neck or other suitable structure. The closure 30 may be fabricated from a synthetic thermoplastic material, or other materials, compatible with the container contents.

Figure 2:
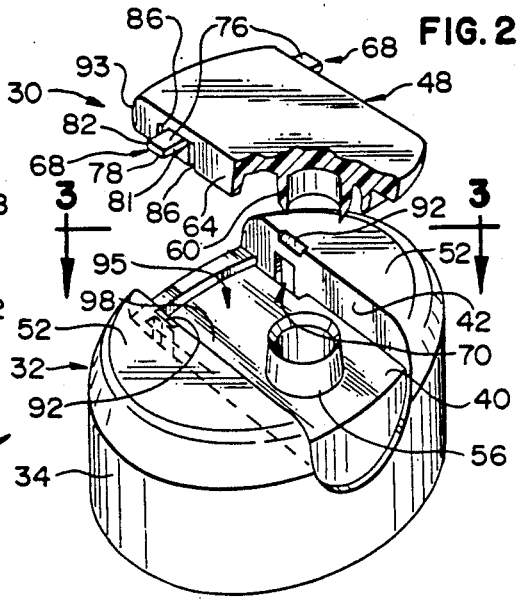
FIG. 2 is an exploded, perspective view of the closure with a portion of the lid shown broken away and shown partially in cross-section.

As best illustrated in FIG. 2, the closure 30 includes a body means or body 32 for securement to the container. The body 32 includes a peripheral wall in the form of an oval skirt or peripheral side wall 34. Other skirt shapes could be used.

Figure 6:
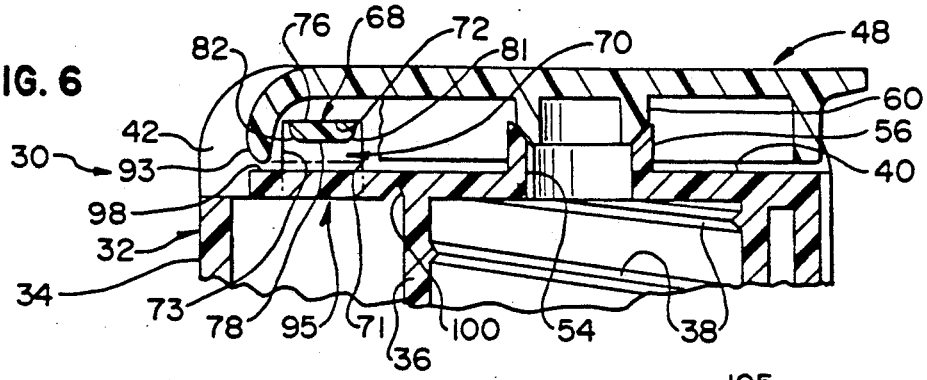
FIG. 6 is an enlarged, fragmentary, cross-sectional view taken generally along the plane 6—6 in FIG. 1.

As best illustrated in FIG. 6, the body 32 includes an internal mounting collar 36 which has, on its interior surface, a conventional thread 38 or other suitable means (e.g., a snap-fit bead (not illustrated)) for engaging suitable cooperating means on the container neck to releasably secure the body 32 to the container.

The body 32 includes a transverse wall 40 as best illustrated in FIG. 2. The body 32 also includes a pair of oppositely facing, spaced-apart, parallel, vertical walls 42 (FIGS. 2 and 3) which together with the transverse wall 40 define an upwardly open recess for receiving the closure lid 48. Extending from the top of each body vertical wall 42 is an upper horizontal wall or surface 52 which is generally coplanar with the top surface of the lid 48 when the lid is received in the body recess in the fully closed position illustrated in FIGS. 1, 4, 5, and 6.

Figure 3:
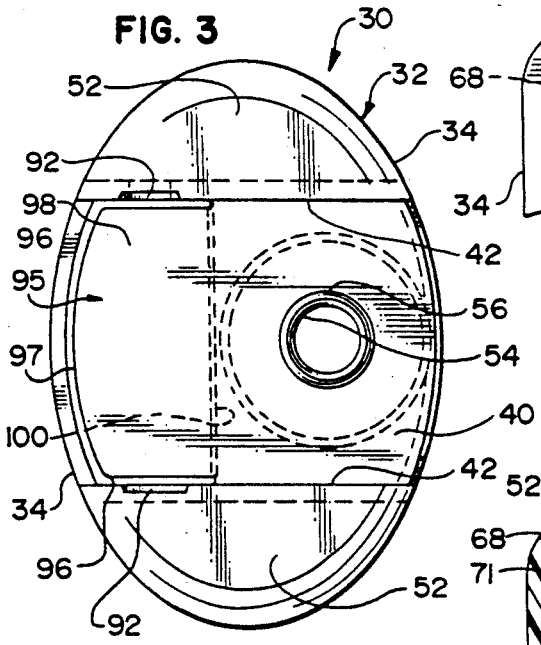
FIG. 3 is an enlarged, plan view of the closure body taken generally along the plane 3—3 in FIG. 2.
Figure 4:
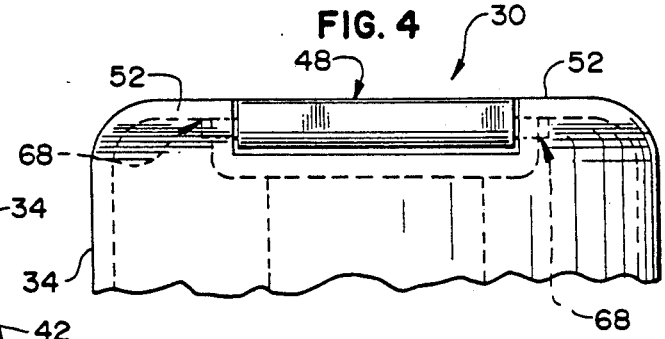
FIG. 4 is a fragmentary, rear, elevational view taken generally along the plane 4—4 in FIG. 1.

As shown in FIG. 3, a dispensing orifice 54 is defined in the transverse wall 40 and is surrounded by a collar or spout 56 projecting upwardly form the transverse wall 40 around the dispensing orifice 54.

The lid 48 is adapted to occlude the dispensing orifice 54 when the lid 48 is in the closed position To this end, the lid 54 includes a downwardly extending spud or plug 60 which is received inside of the collar or spout 56, preferably in a compression fit to effect a tight seal.

Figure 5:
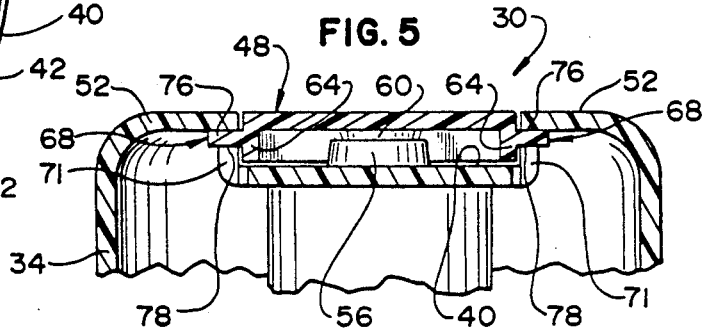
FIG. 5 is a fragmentary, cross-sectional view taken generally along the plane 5—5 in FIG. 1.

A novel structure is provided for pivotally mounting the lid 48 to the closure body 32. Specifically, the lid 48 includes a pair of downwardly extending side flanges 64 (FIGS. 2 and 5). A pivot member 68 projects laterally outwardly from each side flange 64 and is adapted to be received in a receiving means 70 (FIGS. 2 and 6) defined in the adjacent vertical wall 42 in the closure body 32. In the first embodiment illustrated in FIGS. 1–11, each receiving means 70 is a generally rectangular aperture having a front side 71, a top side 72, and a rear side 73. The bottom of the receiving means aperture 70 is open at the bottom edge of the vertical wall 42.

Figure 1:
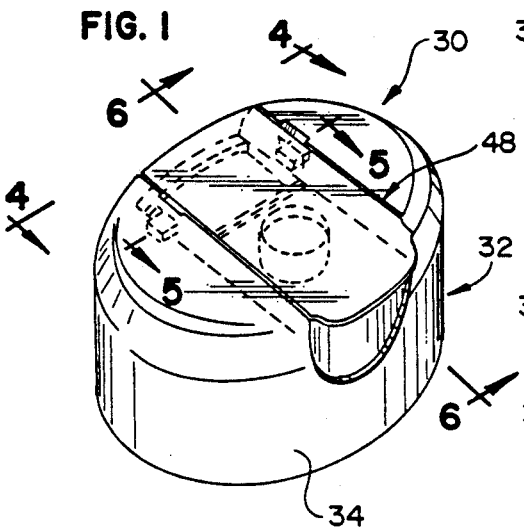
FIG. 1 is a perspective view of a first embodiment of the closure of the present invention which can be installed on a container (not illustrated)

As best illustrated in FIGS. 2 and 6, each pivot member 68 has two oppositely facing flat sides—a top side 76 and a bottom side 78. The oppositely facing flat sides 76 and 78 are joined at one end by a curving end surface 81 and at the other end by a curving end surface 82 as best illustrated in FIGS. 1 and 6. The width of each projection 68 (i.e., the dimension of the top side 76 from front end surface 81 to the rear end surface 82) is somewhat less than the width of the receiving means aperture 70. That is, the top side 72 of the aperture 70 is somewhat longer than each pivot member top side 76.

To accommodate assembly of the lid 48 onto the body 32 so that the lid pivot members 68 are properly received in the apertures 70, novel cooperating structures are provided on the lid 48 and body 32. Specifically, each lid side flange 64 defines a pair of spaced-apart slots 86 (FIG. 2). The slots 86 permit the portion of the side flange 64 between the slots 86 to flex inwardly as the lid 48 is mounted on the closure body 32.

Further, to guide the lid pivot members 68 into the body receiving apertures 70 and to assist in flexing the lid side walls 64 inwardly temporarily as the pivot members 68 are moved downwardly into the body recess 42, the body 32 includes an angled cam surface 92 above each aperture 70 at the edge defined by the body top surface 52 and vertical wall 42. As the lid 48 is moved downwardly into the recess toward the transverse wall 40, the distal end of each pivot member 68 engages the angled cam surface 92. This forces the pivot member 68 inwardly and causes an inward deflection of the portion of the lid side flange 62 from which the pivot member 68 projects. When the lid 48 has been moved downwardly to its properly assembled position, each pivot member 68 is aligned in registry with the associated receiving aperture 70, and the lid side flange 64 returns to its normal, unstressed, vertical configuration to thereby cause the projecting pivot member 68 to enter into the adjacent aperture 70.

A novel feature is provided in this closure for effecting a snap-action movement of the lid 48 between the open and closed positions. To this end, the lid 48 includes a convex cam surface 93 (FIGS. 2 and 6–11) at the rear end of the lid 48. The cam surface 93 engages a novel biasing member in the form of a tab 95 which extends rearwardly as a continuation of the body recess transverse wall 40. The member or tab 95 is cantilevered rearwardly and is not connected to the recess vertical side walls 42 or to the skirt 34. To this end, as best illustrated in FIG. 3, the biasing tab 95 has a pair of oppositely facing side edges 96 each spaced somewhat inwardly of the adjacent side wall 42 of the body recess, and the tab 95 has an arcuate rear edge 97 spaced forwardly of the skirt 34.

Preferably, as best illustrated in FIGS. 2 and 6–11, the biasing tab 95 defines a generally flat engaging surface 98 which faces upwardly toward the lid cam surface 93. Further, the biasing tab 95 is capable of being deflected downwardly (as illustrated in FIGS. 7–11) when the lid cam surface 93 engages the tab 95 and applies a force against the tab 95. To this end, the tab 95 is connected to the body recess transverse wall 40 through a reduced thickness section of material defined by an inverted V-shaped notch 100 (FIGS. 6–11).

In a preferred form of the first embodiment of the invention illustrated in FIGS. 1–11, the closure body 32 and the lid 48 are fabricated from a synthetic thermoplastic material. The nature of the material, in conjunction with the thickness of the material at the notch 100 adjacent the tab 95, permits the tab 95 to be resiliently or elastically deflected or deformed downwardly as illustrated in FIGS. 7–11 in response to the force imposed by the convex cam surface 93 of the lid 48.

Figure 9:
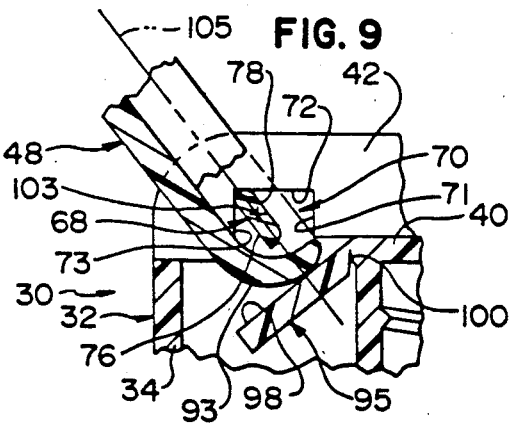
Figure 10:
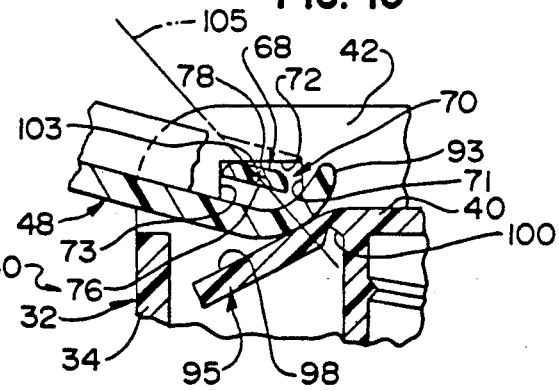

As the lid 48 is moved from the fully closed position (FIG. 6) toward the fully open position (FIG. 11), the tab 95 reaches the point of maximum deflection at the position illustrated in FIG. 9. This may be characterized as the "dead center" or "over center" position in which the biasing member tab 95 is most stressed (at the connection of the tab 95 to the transverse wall 40 above the notch 100).

As illustrated in FIG. 9, the center of the pivot members 68 may be regarded as defining a lid pivot axis 103. The convex cam surface 93 of the lid 48 engages the tab engaging surface 98 substantially along a line of contact that is at all times parallel to the pivot axis 103. A first plane 105 may be drawn through both the pivot axis 103 and the surface 98/surface 93 line of contact. When the lid 48 is at the over center position illustrated in FIG. 9, the plane 105 defined by the pivot axis 103 and surface 98/surface 93 line of contact is perpendicular to the tab engaging surface 98. If the lid 48 is pivoted further toward the open position (i.e., as in FIG. 10), then the plane 105 defined by the line of contact and the pivot axis 103 is tilted past the perpendicular orientation as the deflection of the biasing member tab 95 is reduced. On the other hand, if the lid 48 is moved from the over center point illustrated in FIG. 9 toward the closed position (i.e., as in FIG. 8), then the plane 105 passing through the pivot axis 103 and the line of contact moves in the other direction away from the perpendicular orientation as the deflection of the biasing member 95 is reduced.

On either side of the over center position (FIG. 9), the deflection of the biasing member tab 95 is reduced and the stress is less. The stress and deflection decrease with increasing angular movement of the lid away from the over center position. The lid 48 is thus urged to a stable position at the end of its travel range on that side of the over center position. In this manner, when the lid 48 is closed (FIG. 6), it is self-maintained in the closed position. On the other hand, when the lid 48 is open, it is self-maintained in that position (FIG. 11) to accommodate dispensing of the contents without having to use one's fingers to hold the lid 48 out of the way.

Figure 7:
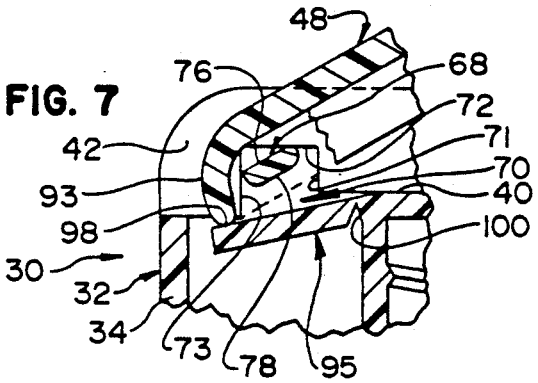
FIGS. 7–11 are fragmentary, cross-sectional views similar to FIG. 6 but showing sequentially moved positions of the components as the closure lid is moved to a full open position.

In the first embodiment of the closure illustrated in FIGS. 1–11, the novel shape of the pivot members 68 and the cooperating novel shape of the receiving means apertures 70 may be employed in a manner to absorb part of the camming reaction forces and, where desired, to permit the pivot axis to be located further rearwardly in the closure than might otherwise be possible. In particular, with reference to FIG. 6, the pivot members 68 are normally positioned up against the receiving aperture top wall 72 when the lid 48 is in the fully closed position. As the lid is opened, the lid cam surface 93 pushes downwardly against the engaging surface 98 of the biasing member tab 95, and the pivot members 68 begin to tilt and engage the rear sides 73 of the receiving member apertures 70 as shown in FIG. 7.

Figure 8:
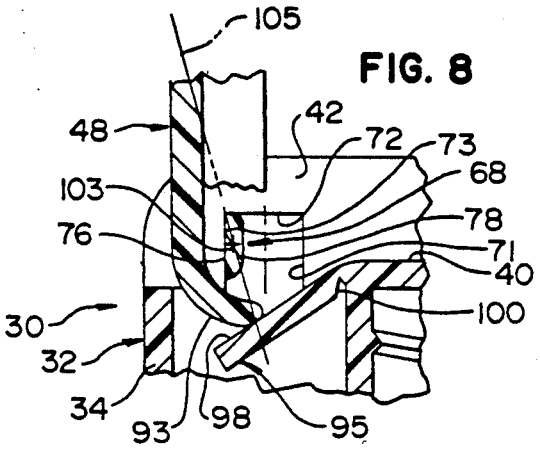

As shown in FIG. 8, further movement of the lid 48 to the open position causes the rear surface 76 of each pivot member 68 to engage the aperture rear side 73. When the over center position is reached as shown in FIG. 9, the sides 76 of the pivot members 68 move away from the rear walls 73 of the aperture 70. Further movement of the lid 48 toward the full open position orients the pivot members 68 in an inverted orientation, and eventually the sides 78 of the pivot members are oriented upwardly against the upper sides 72 of the receiving means apertures 70 as illustrated in FIG. 11.

Figure 11:
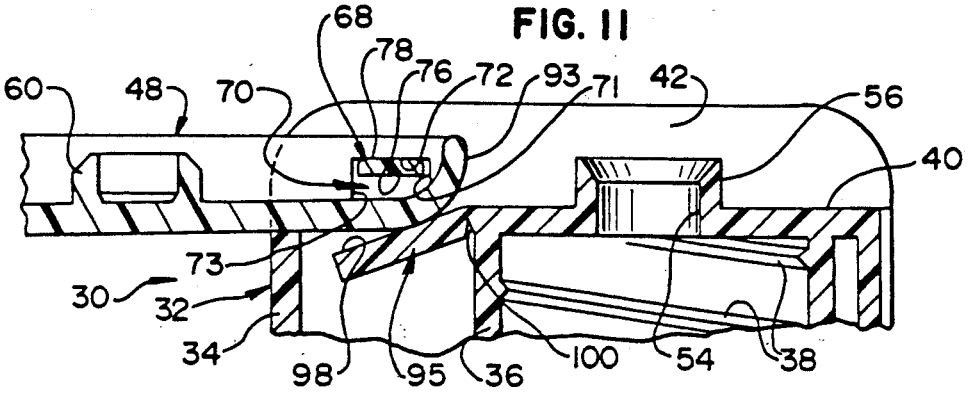
Figure 13:
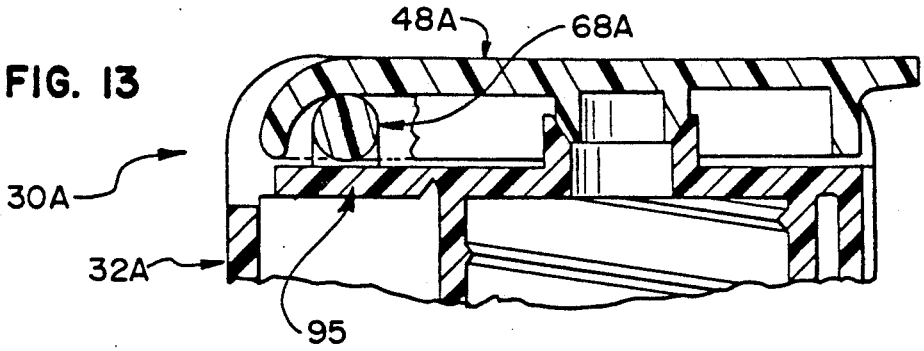
FIG. 13 is an enlarged, fragmentary, cross-sectional view similar to FIG. 6 but showing the second embodiment of the closure.

In the fully open position as illustrated in FIG. 11, the lid 48 still deflects the biasing member tab 95 downwardly some amount. Thus, there is a reaction force applied to the lid 48 by the tab 95 which positively maintains the lid 48 in the full open position.

A second embodiment of the closure of the present invention is illustrated in FIGS. 12–16 and is designated therein generally by the reference numeral 30A. The structural features or elements of the second embodiment of the closure that are identical or functionally analogous to those of the first embodiment of the closure 30 are designated by reference numerals identical to those used for the first embodiment with the exception that the second embodiment reference numerals are followed by the upper case letter A.

The second embodiment structure is substantially identical to the structure of the first embodiment discussed above with reference to FIGS. 1–11. However, the second embodiment has pivot members 68A and receiving means apertures 70A which differ from the pivot members 68 and apertures 70, respectively, of the first embodiment closure 30. In particular, the second embodiment pivot members 68A are generally cylindrical, and each receiving means apertures 70A has a generally semi-cylindrical configuration which is concave downwardly.

Figure 14:
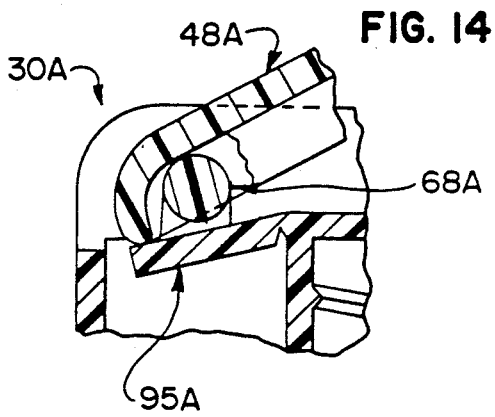
FIGS. 14–16 are fragmentary, cross-sectional view similar to FIG. 13 but sequentially showing the moved positions of the components as the lid is moved to the full open position.
Figure 12:
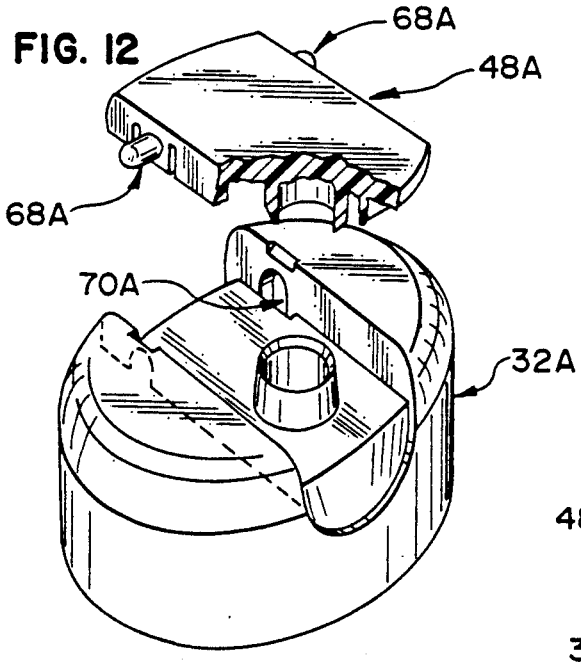
FIG. 12 is an exploded, perspective view of a second embodiment of the closure with a portion of the lid broken away and shown in cross-section.
Figure 15:
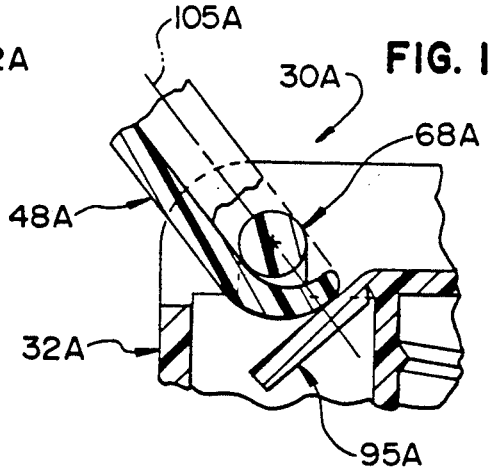
Figure 16:
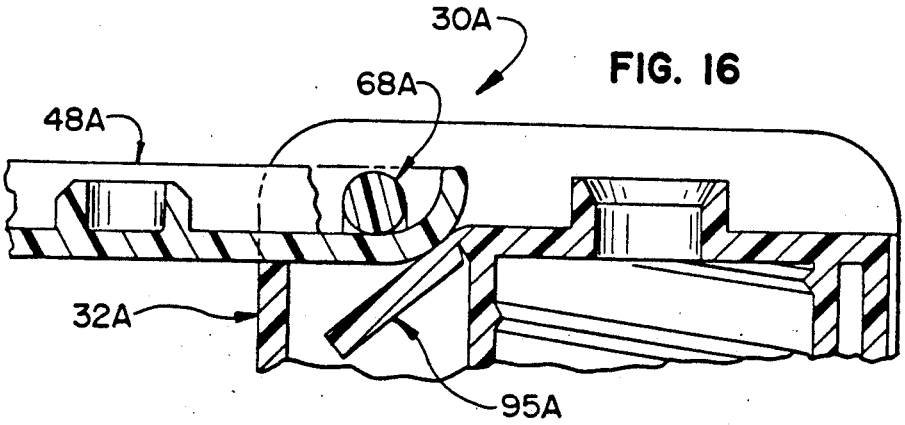
Figure 17:
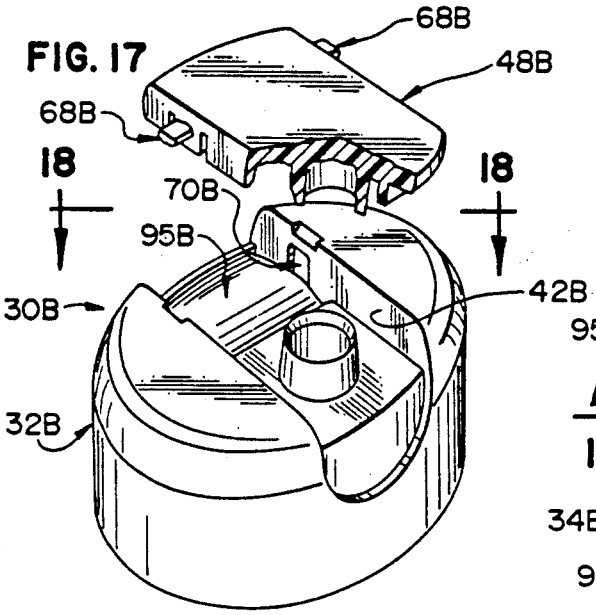
FIG. 17 is an exploded, perspective view of a third embodiment of the present invention with a portion of the lid broken away and shown in cross-section.

In this second embodiment, the pivot axis is defined along the longitudinal axis of the cylindrical configurations of the pivot members 68A, and that pivot axis remains fixed in the receiving member apertures 70A as the lid 48A is pivoted between the closed and opened positions as shown in FIGS. 14–16.

A third embodiment of the closure is illustrated in FIGS. 17–20 and is designated generally therein by reference numeral 30B. The third embodiment of the closure 30B is similar to the first embodiment 30 described above with reference to FIGS. 1-11. The elements or structural features of the third embodiment of the fastener 30B that are identical or functionally analogous to those of the first embodiment of the fastener 30 are designated by reference numerals identical to those used for the first embodiment with the exception that the third embodiment reference numerals are followed by the upper case letter B.

Figure 18:
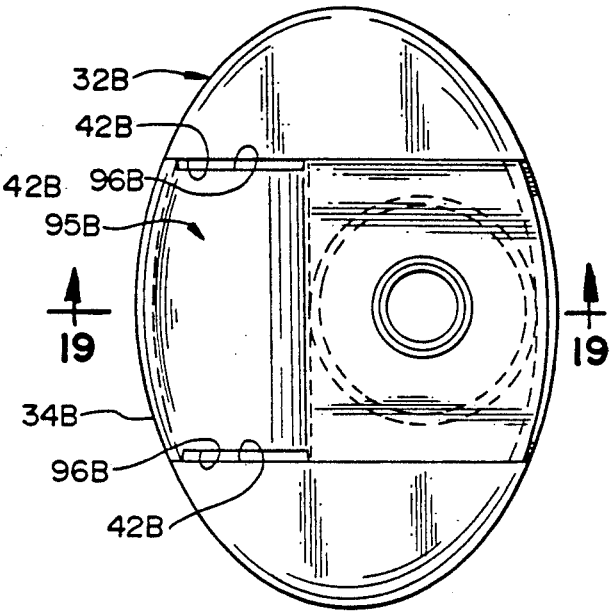
FIG. 18 is an enlarged, plan view of the closure body taken generally along plane 18—18 in FIG. 17.
Figure 19:
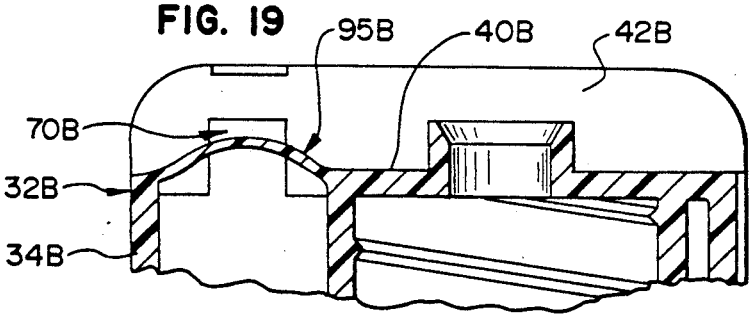
FIG. 19 is an enlarged, fragmentary, cross-sectional view taken generally along the plane 19—19 in FIG. 18.
Figure 20:
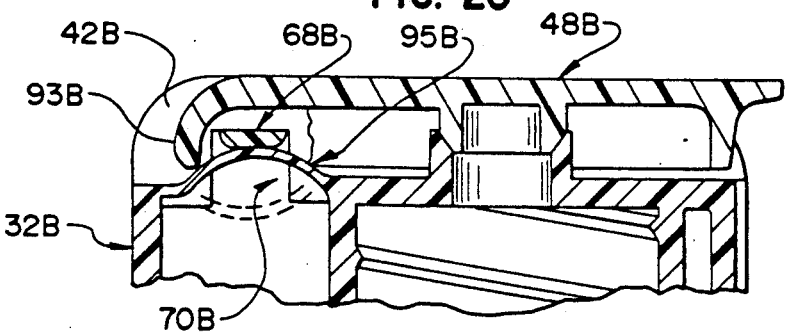
FIG. 20 is a view similar to FIG. 19 but with the lid shown on the closure body in the fully closed position.

The third embodiment of the closure 30B does not employ a biasing member in the form of a tab such as tab 35 of the first embodiment closure 30. Rather, the third embodiment of the closure 30B includes a body 32B which has a resiliently flexible member 95B extending between the body transverse wall 40B and the body skirt 34B. The flexible member 95B is connected at its front end to the transverse wall 40B and at its rear end to the body skirt 34B. The opposite side edges of the flexible member 95B are not connected to the closure body and extend upwardly adjacent the side walls 42B which define the recess in the closure body 32B for receiving the lid 48B. As best seen in FIG. 18, the flexible member 95B has opposite side edges 96B which are each spaced inwardly somewhat from the body vertical walls 42B. Preferably, the closure body 32B is molded from a synthetic thermoplastic material with the flexible member 95B as a unitary part of the closure body 32B. When the closure is closed, the member 95B has an upwardly convex configuration.

With the third embodiment closure 30, the contact between the lid cam surface 93B and the upwardly facing engaging surface of the flexible member 95B occurs substantially along a line parallel to the pivot axis. The pivot axis and line of contact may be characterized as defining a first plane. When the lid 48B is moved to the over center position, the line of contact between the cam surface 93B and the biasing member 95B lies in a second plane which is both tangent to the engaging surface of the member 95B and which is perpendicular to the first plane passing through the pivot axis and the line of contact. At this point, the biasing member 95B is deflected a maximum amount to the position illustrated in dash lines in FIG. 20.

As the lid 48B is rotated from the closed position to the open position, the cam surface 93B engages the flexible biasing member 95B and urges the flexible biasing member 95B downwardly. At the over center point, the flexible biasing member 95B is deformed or deflected downwardly a maximum amount and assumes the upwardly concave configuration illustrated in dash lines in FIG. 20. When the lid 48 is in a position on either side of the over center position, the lid cam surface 93B deflects the flexible member 95B downwardly a lesser amount so that the lid 48B is thereby biased toward one of the open and closed positions.

In the third embodiment of the closure 30B illustrated in FIGS. 17-20, the lid 48B is pivotally mounted by means of the pivot members 68B having the same configuration as the pivot members 68 described above with reference to the first embodiment of the closure 30. The pivot members 68B are received in rectangular apertures 70B which are identical to the apertures 70 of the first embodiment closure 30. However, it is contemplated that the third embodiment of the closure 30B may be provided with the type of pivot mounting means employed in the second embodiment of the closure 30A illustrated in FIGS. 12-16. Specifically, the pivot members 68B may be replaced with cylindrical members, and the receiving apertures 70B may be replaced with semi-cylindrical apertures.

The illustrated embodiments of the closure of the invention include pivot members extending from the lid and include receiving means (for the pivot members) defined in the body. It will be appreciated that the present invention contemplates that this arrangement may be reversed. That is, the pivot members may be provided on the body, and suitable receiving apertures may be provided on the lid. In addition, other shapes of pivot members may be provided along with receiving apertures having suitable corresponding shapes.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A two-piece snap-action closure which can be readily assembled for use on a container defining an opening communicating with the container interior, said closure comprising:

a body for being mounted to said container over said container opening, said body defining a dispensing orifice for communicating at said container opening with said container interior, and said body further defining an elastically deflectable biasing member having an engaging surface;

a lid separate from said body and disposed on said body for pivoting between a closed position occluding said dispensing orifice and an open position spaced away from said dispensing orifice, said lid including a convex cam surface for engaging said biasing member engaging surface as said lid is pivoted between said open and closed positions;

pivot means on one of said lid and body;

receiving means on the other of said lid and body for receiving said pivot means to pivotally mount said lid to said body whereby said biasing member is most stressed when said lid is at an over center point between said open and closed positions to thereby bias said lid toward one of said open and closed positions; and said biasing member is a tab that is cantilevered from said body and that defines a generally flat engaging surface for being engaged by said lid cam surface.

2. A two-piece snap-action closure which can be readily assembled for use on a container defining an opening communicating with the container interior, said closure comprising:

a body for being mounted to said container over said container opening, said body defining a dispensing orifice for communicating at said container opening with said container interior, and said body further defining an elastically deflectable biasing member having an engaging surface;

a lid separate from said body and disposed on said body for pivoting between a closed position occluding said dispensing orifice and an open position spaced away from said dispensing orifice, said lid including a convex cam surface for engaging said biasing member engaging surface as said lid is pivoted between said open and closed positions;

pivot means on one of said lid and body;

receiving means on the other of said lid and body for receiving said pivot means to pivotally mount said lid to said body whereby said biasing member is most stressed when said lid is at an over center point between said open and closed positions to thereby bias said lid toward one of said open and closed positions; and said biasing member is a resiliently flexible member that presents a convex configuration toward said lid in the closed position and that has two ends which are connected to said body on either end of said convex configuration.

3. A two-piece snap-action closure which can be readily assembled for use on a container defining an opening communicating with the container interior, said closure comprising:

a body for being mounted to said container over said container opening, said body defining a dispensing orifice for communicating at said container opening with said container interior, and said body further defining an elastically deflectable biasing member having an engaging surface;

a lid separate from said body and disposed on said body for pivoting between a closed position occluding said dispensing orifice and an open position spaced away from said dispensing orifice, said lid including a convex cam surface for engaging said biasing member engaging surface as said lid is pivoted between said open and closed positions;

pivot means on one of said lid and body;

receiving means on the other of said lid and body for receiving said pivot means to pivotally mount said lid to said body whereby said biasing member is most stressed when said lid is at an over center point between said open and closed positions to thereby bias said lid toward one of said open and closed positions; and said receiving means including a vertical wall defining a rectangular aperture, said pivot means being defined by a lateral projection having at least two oppositely facing flat sides.

4. A two-piece snap-action closure which can be readily assembled for use on a container defining an opening communicating with the container interior, said closure comprising:

a body for being mounted to said container over said container opening, said body defining a dispensing orifice for communicating at said container opening with said container interior, and said body further defining an elastically deflectable biasing member having an engaging surface;

a lid separate from said body and disposed on said body for pivoting between a closed position occluding said dispensing orifice and an open position spaced away from said dispensing orifice, said lid including a convex cam surface for engaging said biasing member engaging surface as said lid is pivoted between said open and closed positions;

pivot means on one of said lid and body;

receiving means on the other of said lid and body for receiving said pivot means to pivotally mount said lid to said body whereby said biasing member is most stressed when said lid is at an over center point between said open and closed positions to thereby bias said lid toward one of said open and closed positions; and one of said body and lid defining an angled cam surface for engaging each said pivot member to guide said pivot means into said receiving means as said lid and body are assembled.

5. The closure in accordance with any one of claims 1–4 in which said receiving means is defined in said body and in which said pivot means is defined on said lid.

6. The closure in accordance with any one of claims 1–4 in which said body defines an upwardly open recess for receiving said lid, said recess is defined on two sides by two oppositely facing, spaced-apart, parallel, vertical, walls, each said vertical wall defines one of said receiving means, said body includes a transverse wall defining the bottom of said recess, and, said transverse wall defines said dispensing aperture.

7. The closure in accordance with any one of claims 1–4 in which said pivot means includes a pair of spaced-apart pivot members;

said receiving means includes a pair of spaced-apart receiving means for each receiving one of said pivot members said pivot members define a pivot axis about which said lid pivots;

the engagement between said engaging surface of said biasing member and said lid convex cam surface at a selected pivoted orientation of said lid occurs substantially along a line of contact;

said line of contact and said pivot axis are parallel and define a first plane;

said line of contact lies in a second plane that is tangent to or coplanar with said engaging surface; and said pivot members, receiving means, convex cam surface, and biasing member are arranged so that when said lid is pivoted to said over center position said biasing member is deflected a maximum amount and said first and second planes are perpendicular.

8. The closure in accordance with any one of claims 1–4 in which said body has a peripheral wall means for being mounted to said container around said container opening; and said body has a transverse wall extending across said peripheral wall means and defining said dispensing orifice.

9. The closure in accordance with claim 4 in which said pivot means includes a pair of spaced-apart pivot members;

said receiving means includes a pair of spaced-apart receiving means for each receiving one of said pivot members;

said lid includes a pair of side flanges; and each said side flange defines a pair of spaced-apart vertical slots;

each said pivot member projects laterally from one of said side flanges between said slots.

10. The closure in accordance with any one of claims 1, 2 or 4 in which said pivot means includes a pair of spaced-apart pivot members;

said receiving means includes a pair of spaced-apart receiving means for each receiving one of said pivot members;

said pivot members are cylindrical; and said receiving means are semi-cylindrical.

* * * * *